US006874992B2

(12) United States Patent
Dailey

(10) Patent No.: US 6,874,992 B2
(45) Date of Patent: Apr. 5, 2005

(54) GAS TURBINE ENGINE AEROFOIL

(75) Inventor: Geoffrey M Dailey, Derby (GB)

(73) Assignee: Rolls-Royce plc, London (GB)

( * ) Notice: Subject to any disclaimer, the term of this patent is extended or adjusted under 35 U.S.C. 154(b) by 50 days.

(21) Appl. No.: 10/294,666

(22) Filed: Nov. 15, 2002

(65) Prior Publication Data

US 2003/0133798 A1 Jul. 17, 2003

(30) Foreign Application Priority Data

Nov. 27, 2001 (GB) ..... 0128311

(51) Int. Cl.[7] ..... F01D 5/08
(52) U.S. Cl. ..... 416/96 R; 416/97 R
(58) Field of Search ..... 416/97 R, 97 A, 416/96 R; 415/115, 116

(56) References Cited

U.S. PATENT DOCUMENTS 4,818,178 A 4/1989 Sibbertsen
4,820,123 A 4/1989 Hall
6,422,817 B1 * 7/2002 Jacala ..... 416/96 R

FOREIGN PATENT DOCUMENTS

EP 0340149 A 11/1989

* cited by examiner

*Primary Examiner*—Edward K. Look
*Assistant Examiner*—Dwayne J. White
(74) *Attorney, Agent, or Firm*—W. Warren Taltavull; Manelli Denison & Selter PLLC

(57) ABSTRACT

An aerofoil blade or vane for a gas turbine engine comprises a body member having an inner end for mounting the blade on a shaft and an outer or tip end. A plurality of cooling passages are formed within the blade, the cooling passages comprising a plurality of inlet passages along which cooling air flows from the base towards the tip region of the blade and a plurality of return passages along which cooling air flows from the tip towards the base region of the blade. At least some of the passages are connected by a common chamber located within the tip region of the blade.

5 Claims, 2 Drawing Sheets

GAS TURBINE ENGINE AEROFOIL

FIELD OF THE INVENTION

This invention relates to gas turbine aerofoil blades or vanes and is particularly concerned with the cooling of such blades or vanes.

BACKGROUND OF THE INVENTION

It is common practice to provide aerofoil blades or vanes for use in the turbines of gas turbine engines with some form of cooling in order that they are able to operate effectively in the high temperature environment of such turbines. Such cooling typically takes the form of passages within the blades or vanes which are supplied in operation with pressurised cooling air derived from the compressor of the gas turbine engine.

In such arrangements the cooling air is directed through passages in the blade or vane to provide convective and sometimes impingement cooling of the blade or vane's internal surfaces before being exhausted into the hot gas flogs in which the blade or vane is operationally situated. The cooling air may also be directed through small holes provided in the aerofoil surface of the blade or vane to supply a film of cooling air over the external surface of the aerofoil to provide film cooling of the aerofoil surface.

It is known to form such passages as one convoluted passageway which allows a length/diameter ratio to be utilised providing an acceptable degree of cooling efficiency. However, such a convoluted passageway necessarily requires bends which give rise to pressure losses without heat transfer. Also each bend requires a hole to be formed through which debris within the cooling air be exhausted.

SUMMARY OF THE INVENTION

According to the present invention there is provided an aerofoil blade or vane for a gas turbine engine comprising an elongated body member having an inner end or base by means of which the blade may be mounted on a shaft, an outer or tip end, and a plurality of cooling passages comprising a plurality of inlet passages along which cooling air flows from the base towards the tip region of the blade and a plurality of return passages along which cooling air flows from the tip towards the base region of the blade, at least some of said inlet and return passages being connected by a common chamber located within the tip region of the blade.

Preferably the aerofoil blade has a leading edge region and a trailing edge region wherein one of said passages is formed within the leading edge region of said blade and includes an opening at its radially inner end through which cooling fluid may be introduced into the passage.

Preferably at least one of said passages is in communication with the exterior of said blade to enable discharge of said cooling fluid from said blade.

Preferably at least one of the convex or concave walls of said blade is provided with an opening connected to the case of a cooling passage so as to provide an exhaust hole for cooling air.

Preferably said cooling passage is arranged to receive cooling fluid at its radially outer opening.

Preferably an exhaust outlet from said cooling passages is in communication with an adjacent vane or blade so as to direct cooling fluid to said adjacent blade.

Preferably said cooling fluid is air.

BRIEF DESCRIPTION OF THE DRAWINGS

An embodiment of the present invention will now be described by way of example only with reference to the accompanying drawings in which.

DETAILED DESCRIPTION OF THE INVENTION

Figure 1:
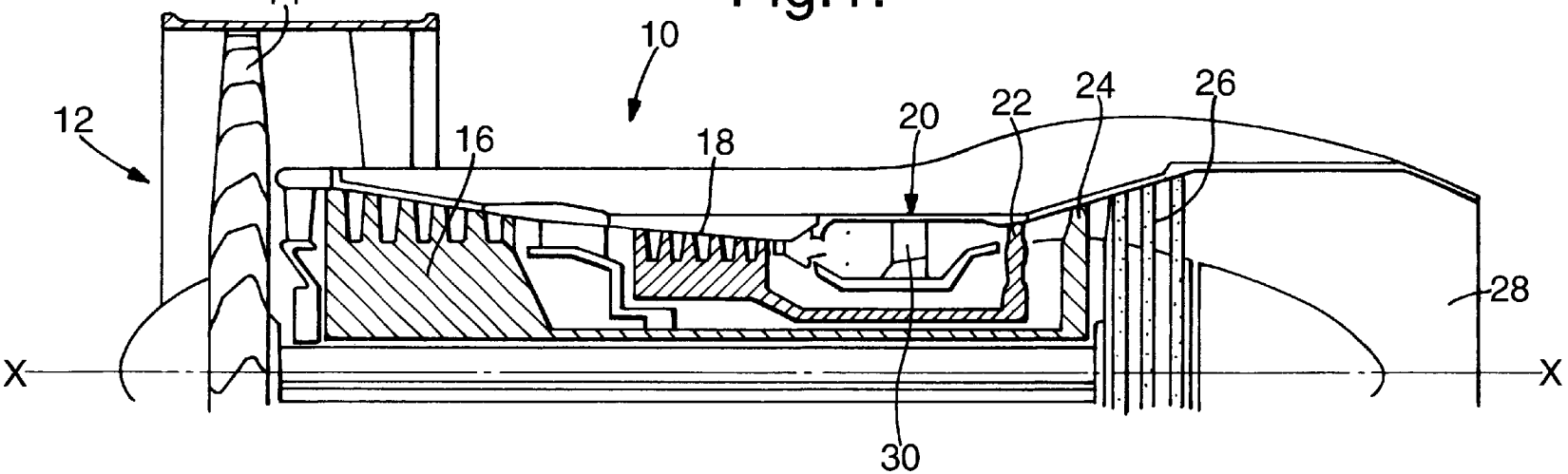
FIG. 1 is an illustrative view of part of a gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second by-pass airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively, drive the high and intermediate pressure compressors 16 and 18 and the fan 14 by suitable interconnecting shafts.

Figure 2:
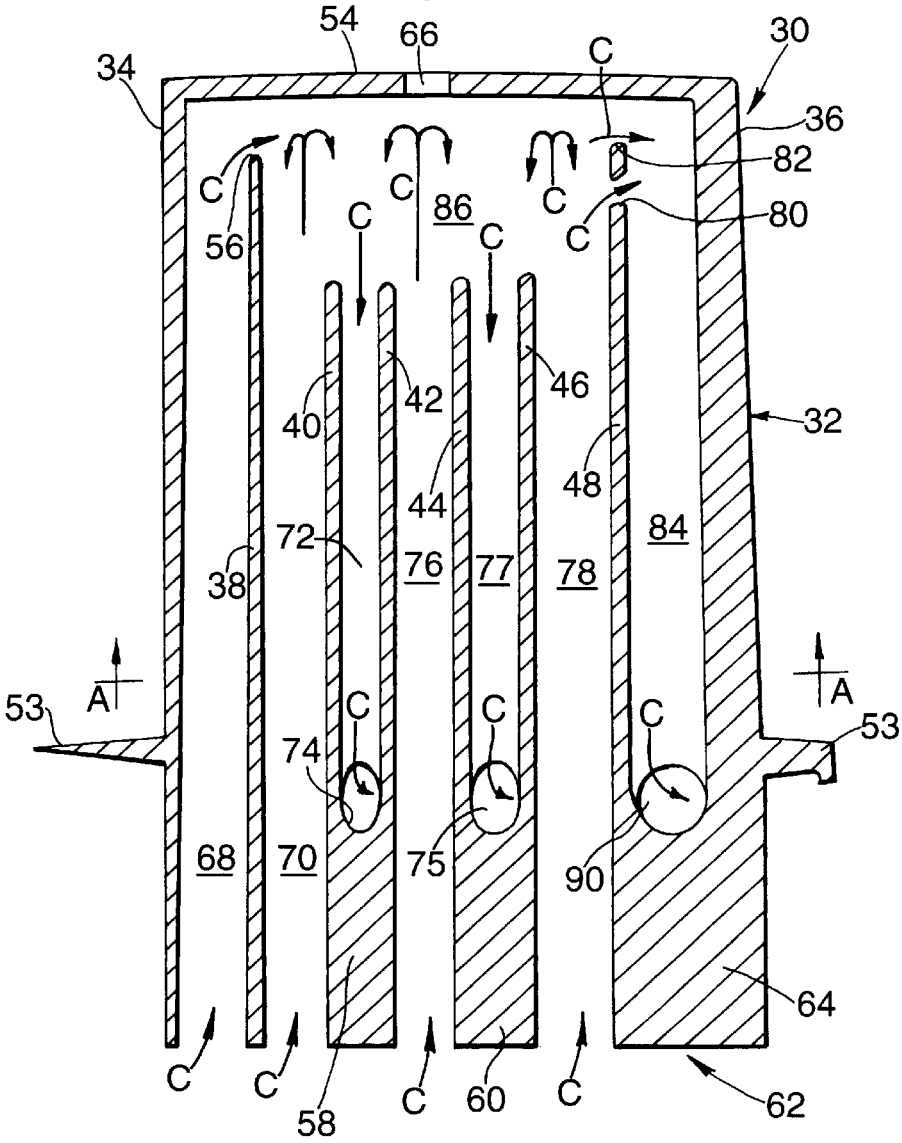
FIG. 2 is a partial cross-section through a turbine blade.
Figure 3:
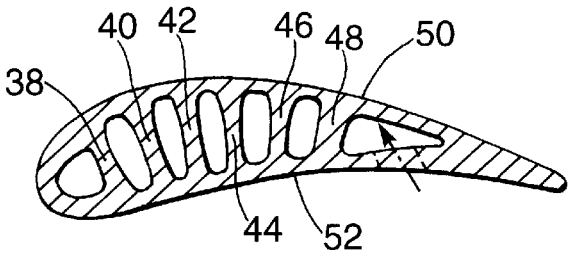
FIG. 3 is a cross-section on the line A—A of FIG. 2.

The high pressure turbine 22 includes an annular array of cooled aerofoil blades, one of which 30 can be seen in FIG. 2. The aerofoil portion 32 of the blade 30 includes a learning edge region 34 and a trailing edge region 36 and is of generally hollow form provided with a series of internal bridging members 38, 40, 42, 44, 46 and 48 which extend from the concave suction side 50 to the convex pressure side 52 of the aerofoil. A blade platform 53 extends outwardly from the aerofoil portion 32 of the blade 30.

The bridging member 38 in the leading edge region of the blade 30 extends substantially the full radial length of the blade 30 but does not reach the tip portion 54 of the blade. The radial length of the blade 30 is that length which extends radially outwardly from the root portion to the tip portion of the blade 30 when arranged as one of any array of blades positioned circumferentially around the appropriate gas turbine engine shaft. Thus a gap is formed between the end 56 of the bridging member 38 and the tip 54 of the blade.

Similarly a gap is formed in the tip portion 54 of the blade as the bridging members 40, 42, 44 and 46 extend a shorter radial length than bridging member 38.

A hole 66 is provided in the tip 54 of the blade 30 and provides an exit for dust particles and debris which may be carried by the cooling air as it passes through the blade 30.

The bridging members divide the hollow interior of the blade 30 into a plurality of passages or channels 68, 70, 72, 76, 77, 78 and 84 through which cooling air may flow.

The bridging members 40 and 42 are formed as a pair extending radially outwardly from a shank portion 58. Similarly the bridging members 44 and 46 also extend from a shank portion 60 located at the base 62 of the blade 30. The bridging member 48 adjacent the trailing edge 36 of the blade 30 also extends radially outwardly from a shank portion 64.

Outlet apertures 74 and 75 are formed at the radially inner ends of the passages 72 and 77 to allow cooling air to be exhausted to the mainstream airflow.

In operation, the interior of the blade 30 is supplied with a flow of cooling air derived from the gas turbine engine compressor. This cooling air is directed into the channels 68, 70, 76 and 78. The direction of the cooling air flow through the blade 30 is shown by arrows C. The cooling air entering channel 68 may be partly exhausted through apertures in the aerofoil wall to form a cooling film on the exterior of the aerofoil. The remainder of the air flows radially outwardly over the tip 56 of bridging member 38 and combines with flow directed into channel 70 to provide impingement cooling of the underside of the blade tip 54. The cooling air is then directed radially inwardly into the passage 72 located between the bridging members 40 and 44 and is discharged through outlet aperture 74 into a zone beneath the blade platform 53.

Similarly cooling air directed into the channels 70, 76 and 78 provides impingement cooling of the undersurface of the tip portion 54 and is subsequently directed radially inwardly into channels 72 and 77 and exhausted between shanks under the blade platforms 53 via exhaust outlets 74 and 75. The cooling air from channel 78 reaches the passage 84 through holes 80 and 82 located in the radially outer portion of the bridging member 48. This provides cooling of the trailing edge portion of the blade which requires greater cooling than the remainder of the blade.

The air entering the region between the shanks is exhausted into the passage 84 through an aperture 90, cooling the rear of the aerofoil and the platforms 53. Air from passage 84 is exhausted through the aerofoil wall to provide film cooling. The holes 80 and 82 limit the temperature at the tip of this passage.

The passageways and chambers formed by the bridging members allow cooling air to flow through the internal region the blade 30 and provide impingement cooling of the underside of the blade tip 54.

Advantageously, the region 86 of the hollow interior of the blade defines a chamber into which cooling air from the channels 68, 70, 76 and 78 is directed. This provides cooling of the blade tip 54 by impingement cooling of its inner surface. As the bridging members 40, 42, 44 arid 46 are foreshortened to define the chamber 86 there is a saving in weight compared with convoluted converted passage arrangements and the disadvantages associated with the bends in convoluted passage arrangements are avoided. Pressure losses are minimised due to the lack of bends and thus the pressure of the cooling air remains relatively high compared to prior art systems which utilise convoluted passageways.

Various modifications may be made without departing from the invention. Thus, for example, the cooling air could be used to provide film cooling through film cooling holes located across the external blade surface if required.

It is also envisaged that the return channels 72, 77 and 84 may be connected to an adjacent vane or blade so as to exhaust cooling air into the adjacent vane or blade.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or nor particular emphasis has been placed thereon.

I claim:

1. An aerofoil for a gas turbine engine comprising an elongated body member having a base and a tip region and having an inner end by means of which the aerofoil may be mounted on a shaft, an outer end, and a plurality of cooling passages comprising a plurality of inlet passages along which cooling air flows from said base towards said tip region of the aerofoil and a plurality of return passages along which cooling air flows from the tip region towards the region of said base of the aerofoil, of said inlet and return passages being connected by a common chamber located within the tip region of the aerofoil, interior wall members defining said inlet and return passages, each of said interior wall members extending from said region of said base toward said tip region end being spaced from said tip region to leave said common chamber unobstructed for the flow of cooling air.

2. An aerofoil as claimed in claim 1 having a leading edge region and a trailing edge region wherein one of said passages is farmed within the leading edge region of said aerofoil and includes an opening at its radially inner end through which cooling fluid may be introduced into the passage.

3. An aerofoil as claimed In claim 1 wherein at least one of said passages Is in communication with the exterior of said aerofoil to enable discharge of said cooling fluid from said aerofoil.

4. An aerofoil as claimed in claim 3 wherein said aerofoil has convex and concave walls and at least one of the convex and concave walls of said aerofoil is provided with an opening connected to the base of a cooling passage so as to provide an exhaust hole for cooling air.

5. An aerofoil for a gas turbine engine comprising an elongated body member having an inner end by means of which the aerofoil may be mounted on a shaft, an outer end, and a plurality of cooling passages comprising a plurality of inlet passages along which cooling air flows from the base towards the tip region of the aerofoil and a plurality of return passages along which cooling air flows from the tip towards the base region of the aerofoil, at least some of said inlet and return passages being connected by a common chamber located within the tip region of the aerofoil wherein at least one of said passages is in communication with the exterior of said aerofoil to enable discharge of said cooling from said aerofoil and wherein said cooling passage is arranged to receive cooling fluid at its radially outer opening.

* * * * *